US011641954B2

(12) United States Patent
Cohen-Solal et al.

(10) Patent No.: US 11,641,954 B2
(45) Date of Patent: May 9, 2023

(54) DEVICE FOR DISPENSING BULK PRODUCTS

(71) Applicant: BULK AND CO, Bazarnes (FR)

(72) Inventors: Frederic Cohen-Solal, Paris (FR); Tammy Boulanger, Bains-sur-Oust (FR); Laurent Dupont, Saint-Nicolas-de-Redon (FR); Emilia Haud, Bazarnes (FR); Arnaud Duqueyroix, Bazarnes (FR); Patrick Maerten, Bazarnes (FR)

(73) Assignee: BULK AND CO, Bazarnes (FR)

( * ) Notice: Subject to any disclaimer, the term of this patent is extended or adjusted under 35 U.S.C. 154(b) by 0 days.

(21) Appl. No.: 17/426,752

(22) PCT Filed: Jan. 31, 2020

(86) PCT No.: PCT/EP2020/052496
§ 371 (c)(1),
(2) Date: Jul. 29, 2021

(87) PCT Pub. No.: WO2020/157316
PCT Pub. Date: Aug. 6, 2020

(65) Prior Publication Data

US 2022/0095814 A1 Mar. 31, 2022

(30) Foreign Application Priority Data

Jan. 31, 2019 (FR) ..... 1900928

(51) Int. Cl.
*A47F 1/03* (2006.01)
*B65D 83/06* (2006.01)

(52) U.S. Cl.
CPC ..... *A47F 1/03* (2013.01); *B65D 83/06* (2013.01)

(58) Field of Classification Search
CPC ..... A47F 1/03; B65D 83/06; G01F 11/24
See application file for complete search history.

(56) References Cited

U.S. PATENT DOCUMENTS 1,219,651 A 3/1917 McDonald et al.
1,321,385 A * 11/1919 Millard ..... G07F 17/24 221/265

(Continued)

FOREIGN PATENT DOCUMENTS

EP 1034728 A2 9/2000
EP 1772077 A1 4/2007

OTHER PUBLICATIONS

International Search Report (ISR) for PCT/EP2020/052496 dated Feb. 27, 2020 (5 pages).

(Continued)

*Primary Examiner* — Vishal Pancholi
(74) *Attorney, Agent, or Firm* — Shumaker, Loop & Kendrick, LLP

(57) ABSTRACT

A device for dispensing a bulk product such as cereals or condiments, including at the top a threaded nozzle for securing to the neck of a container and at the bottom a dispensing opening. A rotary shutter is provided, including a first portion provided with an actuating handle movable relative to a second portion, these two portions comprising respective walls and openings overlapping in a proportion that is dependent on the position of the handle.

23 Claims, 17 Drawing Sheets

(56) References Cited

U.S. PATENT DOCUMENTS

| | | | | | |
|---|---|---|---|---|---|
| 1,982,273 | A | * | 11/1934 | Vogel | G07F 11/44 221/281 |
| 4,560,092 | A | * | 12/1985 | Souza | G01F 11/24 222/242 |
| 5,322,185 | A | * | 6/1994 | Leight | A61F 11/08 221/265 |
| 7,992,748 | B2 | * | 8/2011 | Lawrence | G07F 11/54 221/256 |
| 9,412,216 | B2 | * | 8/2016 | Rudek | G07F 11/54 |
| 2016/0001955 | A1 | | 1/2016 | Wang et al. | |

OTHER PUBLICATIONS

Written Opinion for PCT/EP2020/052496 dated Feb. 27, 2020 (14 pages).

* cited by examiner 10
20
10
20
10
20

DEVICE FOR DISPENSING BULK PRODUCTS

TECHNICAL FIELD

The present invention concerns devices for dispensing bulk solid products in stores, such as dry food products sold by weight.

BACKGROUND

There are known numerous systems for dispensing bulk solid products including a container provided at its base with a dispensing device including an Archimedes screw or a wheel with paddles provided with a handle that the user turns to bring about the dispensing of the product. The use of an Archimedes screw or of a wheel with paddles provides an effective solution against the risk of blocking, but driving it in rotation to dispense the product is relatively tedious, in particular if the quantity to be dispensed is large. Now, in the sale of bulk food products, the quantities taken away are often large. Consequently, these devices are somewhat reserved to the dispensing of individual portions in restaurants for example.

There have been proposed dispensing systems including a container having a section of rectangular general shape and a dispensing device including a pivoting handle, lowering of which opens a shutter. Dispensing is effected by gravity for as long as the handle is lowered. However, these systems are not designed to enable the separation of the container and the dispensing device, and prove relatively tedious to fill and to clean. The container is adapted to be attached at the rear to a wall support, which limits the aesthetic possibilities. The container may instead rest on an inclined plane, which proves bulky and relatively unaesthetic.

Other devices, such as that disclosed in the application EP1034728, necessitate turning the container over to dispense a dose and are not suitable for use in stores.

There is further known a system for dispensing cereals including a diaphragm shutter. This kind of system is designed for individual use and the mechanical production of a diaphragm is relatively complex and costly.

STATEMENT OF INVENTION

The invention aims to improve dispensing systems in order in particular to enable hygienic filling of the container.

The invention also aims to facilitate adapting the dispensing device to the nature of the product to be dispensed, if necessary.

SUMMARY OF THE INVENTION

The invention aims in particular to address some or all of the above requirements and, in a first of its aspects, has for object a device for dispensing by gravity a bulk solid product, including:

- at the top, a nozzle for removably fixing it to a container, in particular to a neck of the latter,
- at the bottom, a dispensing orifice,
- a preferably rotary shutter including a first part with an actuating handle that is mobile, in particular in rotation, relative to a second part, these two parts including respective walls and openings overlapping in a proportion that is dependent on the position of the handle.

The rotation is preferably effected about a rotation axis coinciding with the longitudinal axis of the device. The angular travel in rotation of the handle is preferably less than or equal to 180°, better 150°. The rotation axis of the handle is preferably vertical.

The invention enables easy and very hygienic replacement of an empty container by a full container, which avoids having to clean and to fill the container in place.

It suffices to separate the empty container from the dispensing device and t replace it with a full new one.

Moreover, opening can be effected by a simple, intuitive and non-tiring gesture, and it is easy to deliver the required quantity, even if the latter is large. The product flows by gravity through the dispensing device as long as the shutter is open, without it being necessary to turn over the container.

The mobile part may include only one opening, but the mobile part preferably includes a plurality of openings. This can enable the flow rate to be increased and the risk of blocking of the openings reduced.

The mobile part may include between the openings thereof separators projecting toward the container. These separators advantageously have inclined flanks guiding the flow toward the openings situated at their base. The risk of product accumulating inside the dispensing device is therefore reduced, which is advantageous from the hygiene point of view. Moreover, the separators move the product when the mobile part is actuated, which further reduces the risk of blocking.

In a variant, the separators take the form of paddles oriented perpendicularly to the wall to which they are connected at their base.

Alternatively, the body includes separators projecting toward the container. The separators may have inclined flanks guiding the flow toward the openings of the second part situated at their base.

Alternatively, the second part includes separators projecting toward the container. The separators may have inclined flanks guiding the flow toward the openings situated at their base.

The device may include a guide member serving as a funnel, and the latter may be disposed at the center of the body, notably at the foot of the flanks.

The guide member may include a rod having first and second portions separated by a shoulder, the first rod portion including a plurality of paddles guiding the flow toward the openings in the second part. The guide member may be fixed relative to the second part.

Alternatively, the latter member is mobile, in particular in rotation relative to the second part.

The member is for example rigidly connected, in particular screwed, to the first part.

The device preferably includes a spring for urging the mobile part into a shutter closing position.

The first and second parts are received in a corresponding housing of the body of the dispensing device and are preferably arranged to nest one within the other. This enables compactness to be improved and one of the parts to be used to guide the other in rotation, and thus to render this guidance relatively independent of the shape of the body of the dispensing device. It is then easy to change the first and/or second part(s) to adapt the shutter to a particular product without having to change the body of the dispensing device. This therefore provides some modularity facilitating the adaptation of the dispensing device to diverse products. This change may be effected by way of the opening of the body facing the container.

Alternatively, the first and second parts are disposed outside a body of the dispensing device and are preferably adapted to nest one within the other.

The openings of the first and second parts are preferably produced in respective walls in contact with one another so as to obtain an effective closure.

The body of the device may include an opening for the handle controlling the shutter to exit.

The dispensing orifice may be defined by a spout. The latter has for example a symmetrical circular shape with an interior section that converges towards the dispensing orifice. The presence of the spout facilitates the positioning of the jar, sachet or other container intended to be filled.

The device preferably includes a third part the position of which relative to the second part enables adjustment of the flow rate of the flow reaching the dispensing orifice. The third part is preferably mobile relative to the second part, which facilitates the adjustment. In particular, this enables the flow rate to be adapted to the nature of the product. The third part may be constrained to move with an adjustment lever. This lever may be positioned by the user as a function of the required flow rate. The third part may include a wall and at least one opening overlapping to a greater or lesser degree an opening in the second part as a function of the position of the flow rate adjustment lever.

The third part may be received in the body of the dispensing device in a removable manner. This enables easy replacement and adaptation of this part to the nature of the product and/or to the manner in which the product is offered.

The handle of the shutter and the flow rate adjustment lever may be situated on the same side of the device. This encourages the person using it to adjust the flow rate if necessary.

Alternatively, the control handle of the shutter and the flow rate adjustment lever are situated on opposite sides of the device. This arrangement is to be preferred when it is not required that the user changes the flow rate for which the device has been preset by the staff of the store.

The aforementioned nozzle is preferably internally threaded for screwing it onto the container, the neck of the latter being threaded. There is thus provided a simple means of fixing the container to the dispensing device and the possibility of closing the full container with the aid of a cap screwed onto the neck. The aesthetic possibilities are numerous.

The height of the dispensing device ranges for example from 100 to 150 mm. The outlet diameter of the dispensing orifice ranges for example from 10 to 30 mm.

The invention further has for object a dispensing system including a container to contain the product to be dispensed and a dispensing device in accordance with the invention as defined hereinabove.

The container is sometimes referred to as a "silo", and here may serve both for storage pending dispensing in the store and for transport to the store. The container may be equipped with a removable cap, which is removed to place it on the dispensing device.

In this kind of system the container contains a food product.

The weight of the full container is for example between 0.5 and 10 kg inclusive, better still between 1 and 5 kg.

The container is preferably made of transparent material, in particular glass or transparent plastic material, for example polycarbonate. It may have circular symmetry.

The container is preferably made of glass.

The system may include a clamping part adapted to retain the dispensing device on the support.

The clamping part may include a plate that can come to abut against the lateral edge of the support and two forks substantially perpendicular to that plate.

During the dispensing of the product the container remains immobile, fixed relative to its support. There is no need to turn it over to dispense a dose of product.

The invention further has for object a display unit including a support and at least one dispensing system in accordance with the invention retained by the support.

The support may include at least one opening and the support and the container are adapted to enable the container to be positioned in the opening in a stable manner on the one hand in accordance with a use configuration in which the container is equipped with a dispensing device and on the other hand in a reverse filling or assembly configuration in which the dispensing device has been removed. The dispensing device may pass vertically through the openings in the support.

If necessary, the opening may include at least one notch for the control handle of the shutter to pass through.

The notch may open toward a lateral edge of the support.

The opening may include a shoulder and the device a flange that comes to bear against that shoulder when it is in place in the opening.

The display unit may carry containers of diverse shapes and/or sizes equipping identical dispensing devices. These containers advantageously have necks with identical screw threads. Alternatively, adapter rings are provided.

Retaining the dispensing system in an opening in the support makes it possible to avoid any requirement for fixing to a wall whilst benefiting from a compact dispensing system. The space freed up may be exploited to space out the containers or to increase the number thereof and to propose new shapes for the containers that are aesthetically attractive.

The invention further has for object a method of replacing a container of a dispensing system in accordance with the invention carried by the display unit during which the dispensing device is separated from the empty container and the dispensing device is coupled to a full container intended to replace the empty container. To facilitate this operation the full container may be placed upside down on the support if the shapes of the latter and of the container enable this.

In accordance with another of its aspects, independently in combination with the foregoing one, the invention further has for object a container for a dispensing system in accordance with the invention including a conical body widening towards its base and connecting to the base by way of a transverse wall with a threaded neck.

The bulk product to be dispensed may be shipped in this kind of container, closed by a removable cap.

Apart from its original aesthetic shape, which when the container is positioned upside down recalls the shape of the piles of spices on merchants' displays, this kind of container enables packaging in boxes with a reduced waste of space by disposing adjacent containers head-to-tail.

This kind of container is preferably made of transparent plastic material, as mentioned above, and its volume may range from 0.5 to 10 liters for example, better still from 1 to 5 liters.

The aforementioned transverse wall is preferably perpendicular to the longitudinal axis of the container so as to rest in a stable manner on a recess flanking the opening in a support intended to receive the dispensing system.

The height of the container is for example between 100 and 500 mm inclusive, better still between 200 and 400 mm inclusive. The diameter at the base of the cone ranges for example from 150 to 250 mm.

BRIEF DESCRIPTION OF THE DRAWINGS

FIG. 2 represents separately one example of a dispensing system in accordance with the invention.

DETAILED DESCRIPTION

Figure 1:
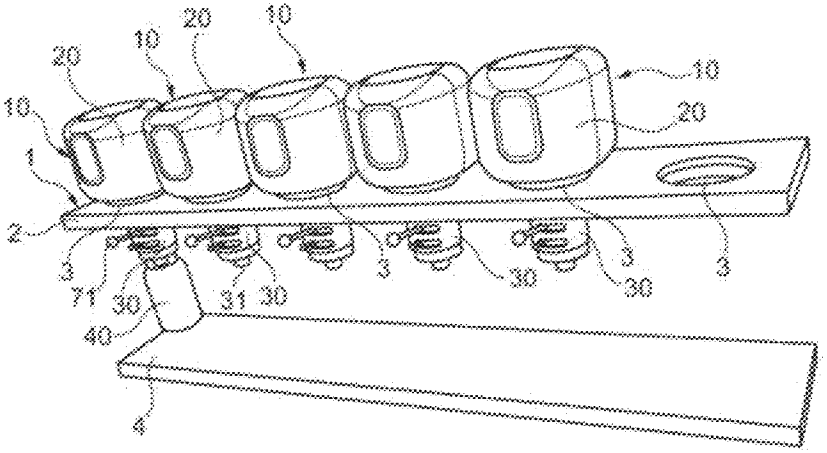
FIG. 1 represents a display unit equipped with a plurality of dispensing systems in accordance with the invention.

There has been represented in FIG. 1 a display unit 1 including a support 2 provided with a plurality of openings 3 each receiving a dispensing system 10 including a container 20 and a dispensing device 30 fixed to that container 20.

Each container 20 contains a bulk product, preferably a dry product, in particular a food product, for example cereals, dried fruits, spices, sugar, flour, preserves, etc, . . . .

The display unit 1 includes at least one space 4 enabling placing under the dispensing orifice 31 of a device 30 a collecting means 40 such as a jar, a box or a sachet, to collect the product delivered by gravity by the dispensing system 10. As illustrated, the collection means is preferably a jar having a threaded neck 41, as illustrated in FIGS. 2 and 3.

The dispensing device 30 includes a body 32 which as shown may include a shouldered cylindrical part 32*a* connected at the top by a conical part 32*b* to a cylindrical part 32*c* of greater diameter serving as a nozzle for connecting the container 20.

The cylindrical part 32*c* is threaded internally for fixing it to a threaded neck 21 of the container 20.

Figure 3:
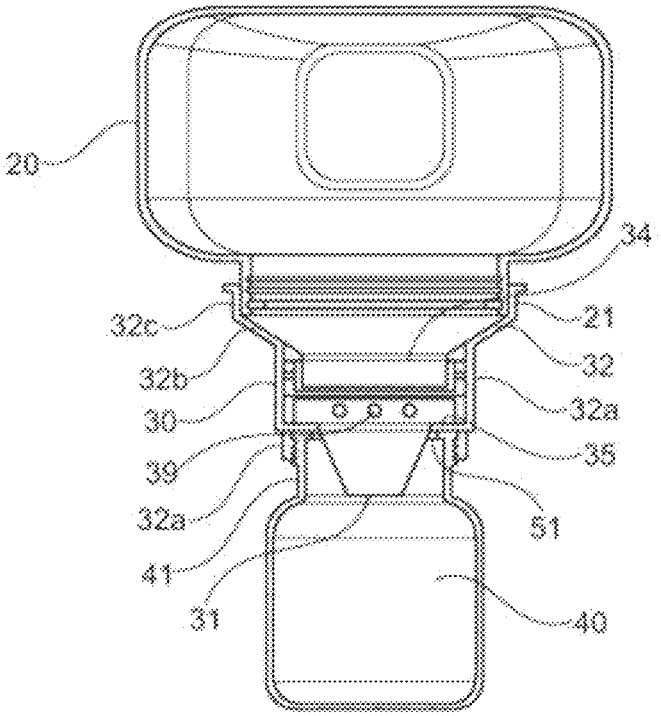
FIG. 3 represents the dispensing system from FIG. 2 in axial section.

The shouldered cylindrical part 32*a* is also threaded internally to enable the collecting jar 40 to be screwed onto the device 30, as illustrated in FIGS. 1 and 3.

The body 32 may include an interior shoulder 34 at the base of the cylindrical part 32*c* serving as a seat for an annular seal 50 that is clamped between the end of the neck 21 and the shoulder 34.

The shouldered cylindrical part 32*a* may include a wall 35 situated at the level of the shoulder in this part, which serves as a seat for an annular seal 51 intended to be placed between the wall 35 and the end of the neck 41 of the jar 40.

Figure 4:
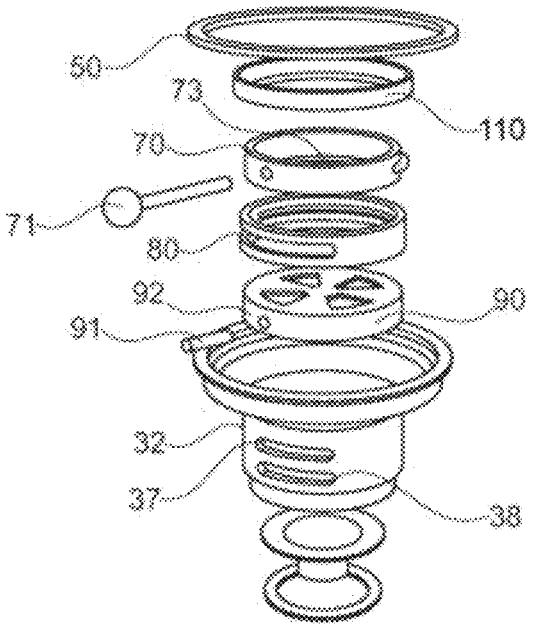
FIG. 4 is an exploded view of the dispensing system from FIG. 2.
Figure 5:
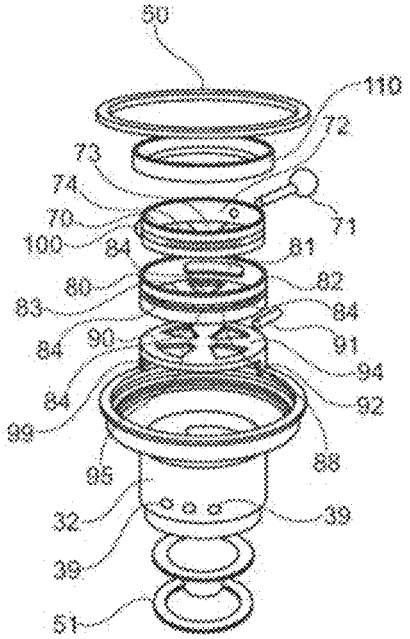
FIG. 5 is a view analogous to FIG. 4 from a different point of view.

The region of the body 32 situated between the wall 35 and the conical part 32*b* houses a first part 70 provided with a control handle 71, as shown in FIGS. 4 and 5, a second part 80 and a third part 90 equipped with an adjustment lever 91.

The first part 70 and the second part 80 together form a shutter.

The second part 80 is fixed relative to the body 32 and the first part 70 is able to turn about the longitudinal axis X of the system 10 when the user moves the handle 71. The latter is accessible from the outside through a first opening 81 in the second part 80 and a second opening 37, overlapping the first, in the body 32.

The second part 80 includes a tubular skirt 82 and a bottom wall 83 through which pass four openings 84 disposed at 90° to one another.

The first part 70 includes a tubular skirt 72 concentric with the skirt 82 and guided in its rotation movement by the latter and a bottom wall 73 through which pass openings 74.

The third part 90 includes a tubular wall 92 interrupted angularly over an angular sector 94 the extent of which is for example between 90° and 150° inclusive.

The body 32 includes an opening 38 through which the adjustment lever 91 exits and air inlet orifices 39 on the opposite side.

In the FIG. 2 example the openings 37 and 38 are situated on the same side of the body 32 so that the handle 71 and the lever 91 are easily actuated by the person wishing to use the device.

Figure 6:
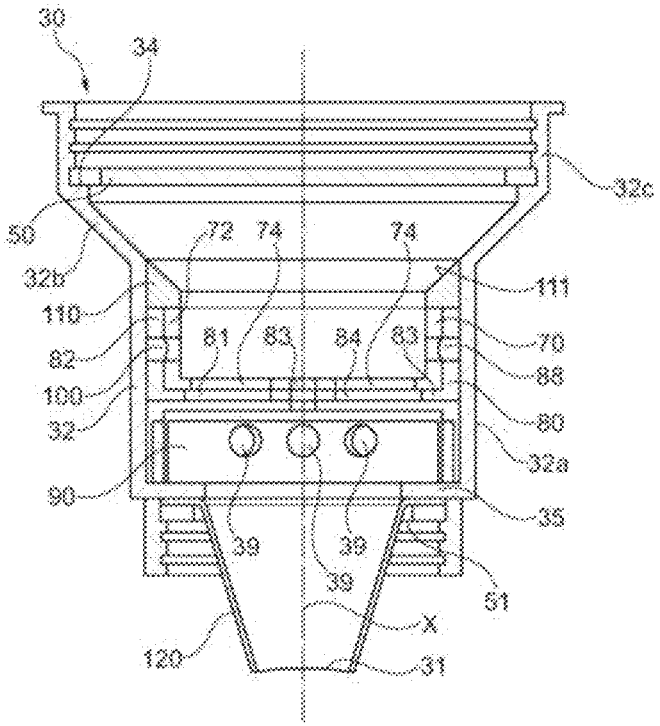
FIG. 6 represents separately the dispensing device in axial section.

A return spring 100 acts between the first and second parts 70 and 80 to urge the first part into a blocking position in which the openings 74 in the bottom wall 73 overlap the solid parts of the bottom wall 83. This spring 100 is for example a coil spring attached at its ends to the parts 70 and 80, respectively, extending outside the skirt 72 around the latter. The skirt 82 may include a corresponding slot 88 receiving the spring 100 within its thickness, as can be seen in FIG. 6 in particular.

The blocking position advantageously corresponds to the handle 71 coming to abut against one end of the opening 81 and/or of the opening 37, the openings 81 and 37 advantageously having the same angular extent and the same height.

When the handle 71 is actuated the first part 70 is moved angularly relative to the second 80 and the openings 74 and 84 overlap, enabling the product to pass through.

The spring 100 advantageously allow complete overlapping of the openings 74 and 84, and this position preferably corresponds to the handle 71 coming to abut against one end of the opening(s) 81 and/or 37.

When the handle 71 is released, the spring 100 returns it into the blocking position.

The third part 90 is situated axially under the second 80 and is able to turn relative to the latter if the user operates the adjustment lever 91.

The third part includes a tubular skirt 92 and a bottom wall 94 through which pass openings 95 that are for example, as shown, four in number and disposed at 90° to one another. The skirt 92 includes an open sector 99.

Depending on the angular position of the third part relative to the second, the openings 95 overlap the openings 84 to a greater or lesser extent and the passage section offered to the product is modified, which makes it possible to act on the flow rate of the flow.

The angular extent of the open sector 99 is sufficiently large for the orifices 39 not to be masked by the skirt 92 regardless of the position of the lever 71 in the opening 38.

The device 30 may equally include an annular deflector 110 that as shown in FIG. 6 comes to be positioned above the assembly formed by the nesting of the parts 70 and 80, has a top face 111 having the same inclination as the conical part 32*b*, and the bottom edge of which is situated vertically in line with the radially interior surface of the skirt 72.

The device 30 includes a spout 120 that defines the dispensing orifice 31 at its bottom end.

In the example considered, this spout 120 has circular symmetry about the longitudinal axis X of the device 30 with a flange at its top edge fixed to the wall 35.

The cylindrical part 32*a* of the body 32 is threaded internally to enable the jar 40 to be screwed on, if necessary, as illustrated in FIG. 1.

Numerous modifications may be made to the dispensing device without departing from the scope of the present invention.

Figure 7:
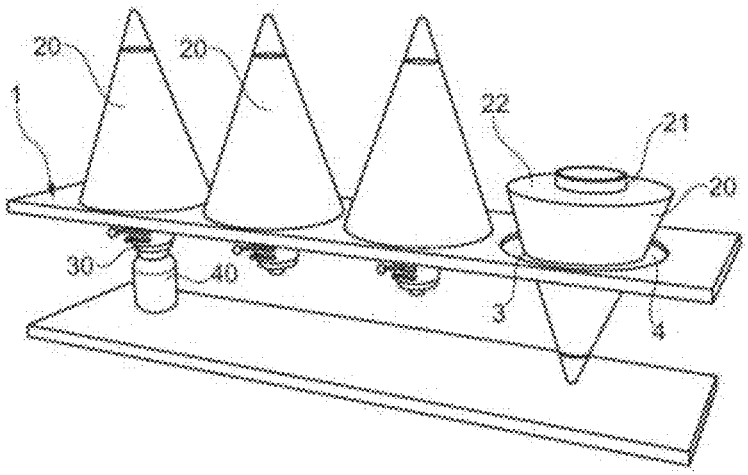
FIG. 7 illustrates a variant display unit and container.

In particular, as illustrated in FIG. 7, there may be used containers 20 of conical general shape with a threaded neck 21 connected at the base of the cone by a wall 22 generally perpendicular to the longitudinal axis of the container.

When it is coupled to the dispensing device 30 the container may rest with its wall 22 on the support 1 with the neck 21 oriented downward.

When the container must be filled or changed, it may be positioned on the support 1 after turning it over, as illustrated in FIG. 7. The diameter of the opening 3 of the support 1 is smaller than that of the container, as measured at the base of the cone.

The opening 3 may be flanked by an annular depression 4 such as a recess, as can be seen in FIG. 7, which enables the container to be centered in the opening 3 when it is in the position of use, the diameter of this recess 4 substantially corresponding to the greatest diameter of the container at the base of the cone.

Figure 8:
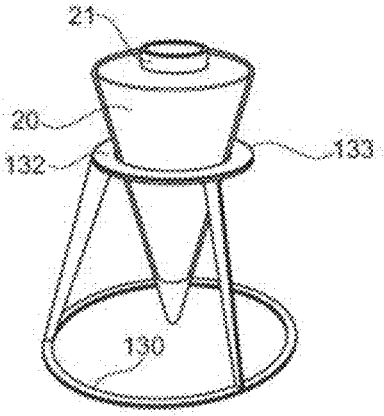
FIG. 8 is a view analogous to FIG. 7 illustrating a variant display unit with the container in the filling configuration.
Figure 9:
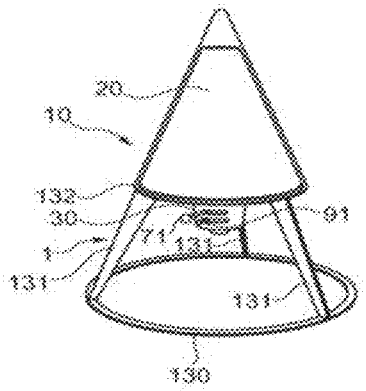
FIG. 9 represents the display unit from FIG. 8 with the dispensing system in the configuration of use.
Figure 10:
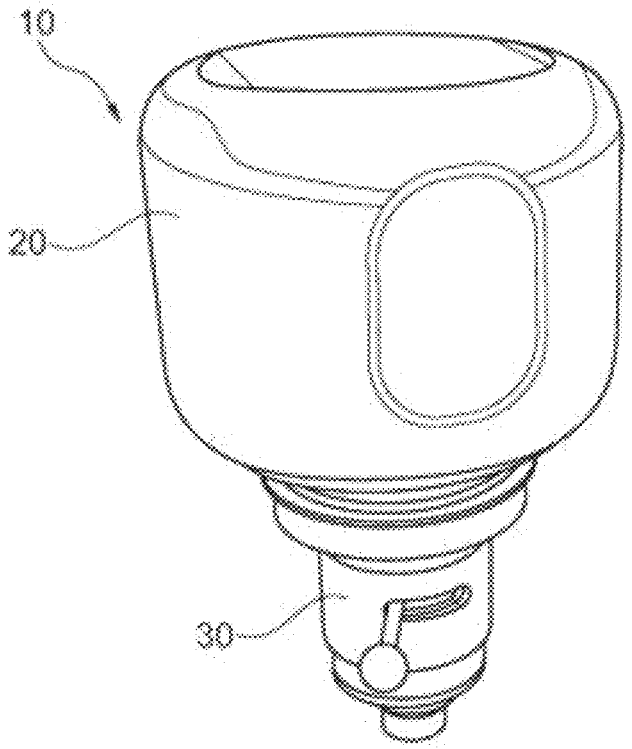
FIG. 10 represents a variant dispensing system in perspective view as seen from the front.
Figure 11:
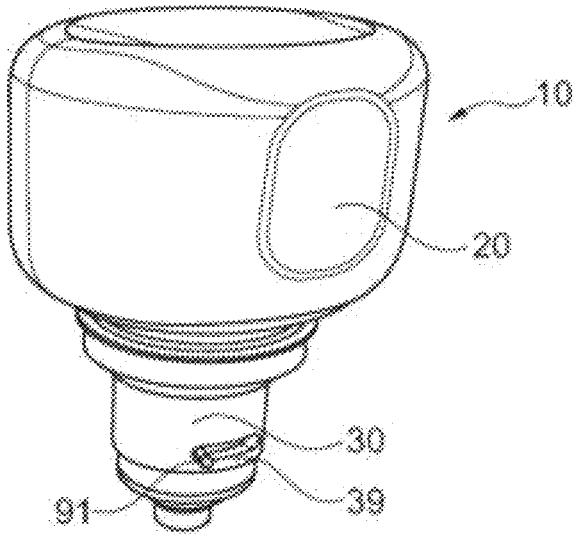
FIG. 11 represents the dispensing system from FIG. 10 as seen from the rear.

There has been represented in FIGS. 8 and 9 a variant support 1 including a first ring 130 at its base, resting on the floor, and three feet 131 connected at their bottom end to the ring 130 and joined at their top end by a second ring 132 of smaller size than the first but with an inside diameter less than the greatest diameter of the container 20 so as to retain the latter when it is turned over, as illustrated in FIG. 8.

The ring 132 may as illustrated be flanked by a peripheral rib 133 for centering the container 20 when the latter is positioned on the support 1 with the neck 21 at the bottom, as in FIG. 9.

A variant dispensing device 30 will now be described with reference to FIGS. 10 to 16.

Figure 12:
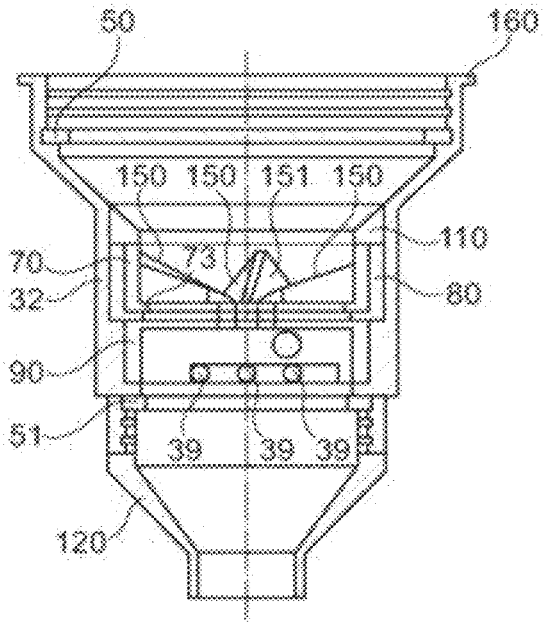
FIG. 12 represents separately the dispensing device of the system from FIGS. 10 and 11 in axial section.
Figure 13:
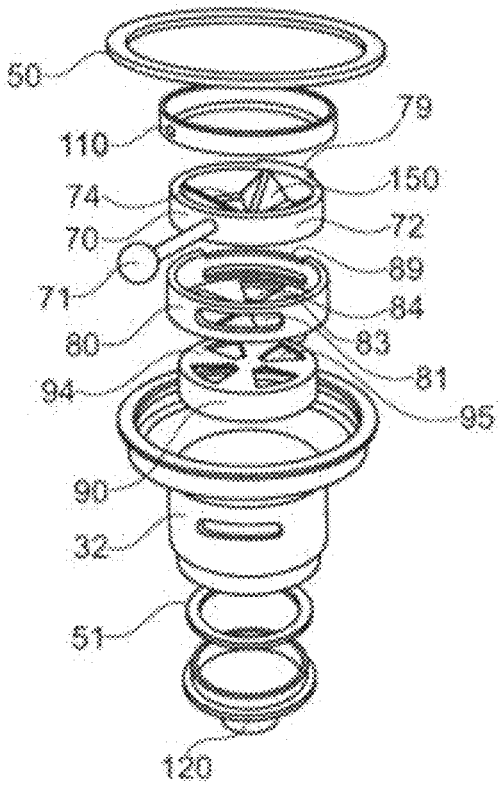
FIG. 13 is an exploded view of the dispensing device from FIG. 12.
Figure 14:
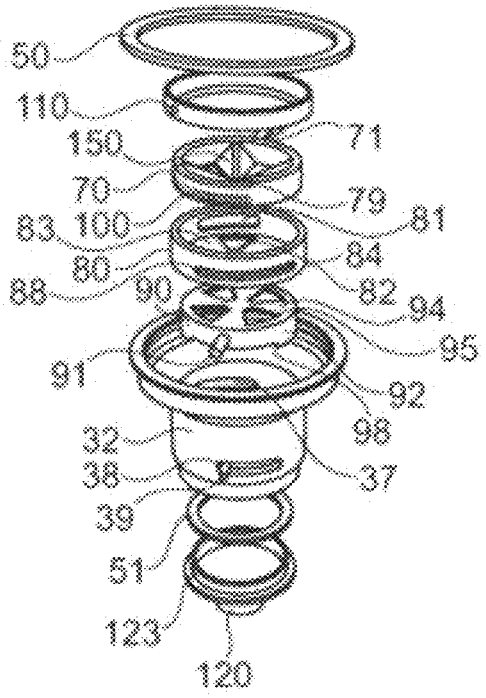
FIG. 14 is a view analogous to FIG. 13 from a different point of view.

In this variant the spout 120 is a part adapted to be screwed onto the body 32 and to this end includes an externally threaded skirt 123 in the top part. The seal 51 may be positioned between the bottom of the housing receiving the skirt 123 and the end of the latter, as can be seen in FIG. 12.

The air inlet orifices 39 are in this example positioned under the opening 38 allowing the flow rate adjustment lever 91 to exit.

The skirt 92 of the third part may include a notch 98 facing these orifices so that the latter are not blocked by the skirt 92.

Figure 15:
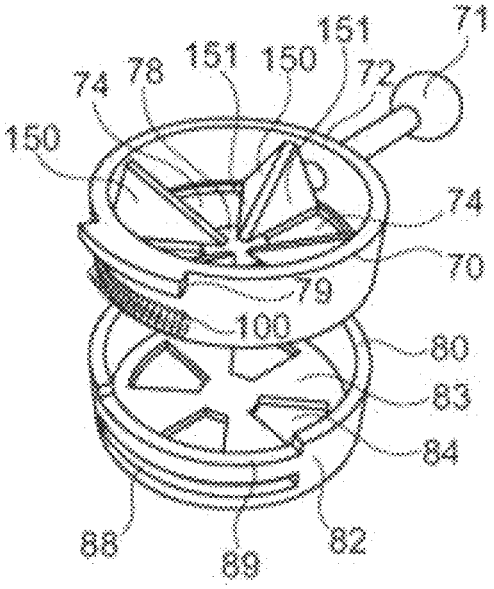
FIG. 15 represents an implementation detail of the device.

The first part 70 includes separators 150 more particularly visible in FIG. 15.

These separators 150 have inclined flanks 151 that open at the bottom onto the orifices 74 in such a manner as to guide the flow of product toward the latter.

It is seen in FIG. 15 that the separators 150 may extend radially as far as a central region 78 of the bottom wall 73, which improves the mechanical retention of the latter. The separators 150 may have a height that decreases toward the center of the first part, as illustrated.

The skirt 72 of the first part 70 may include a lug 79 in the top part that engages in a corresponding notch 89 formed in the top edge of the skirt 82 of the second part 80 so as to limit the angular movement of the first part relative to the second between the completely closed and fully open positions.

Figure 16:
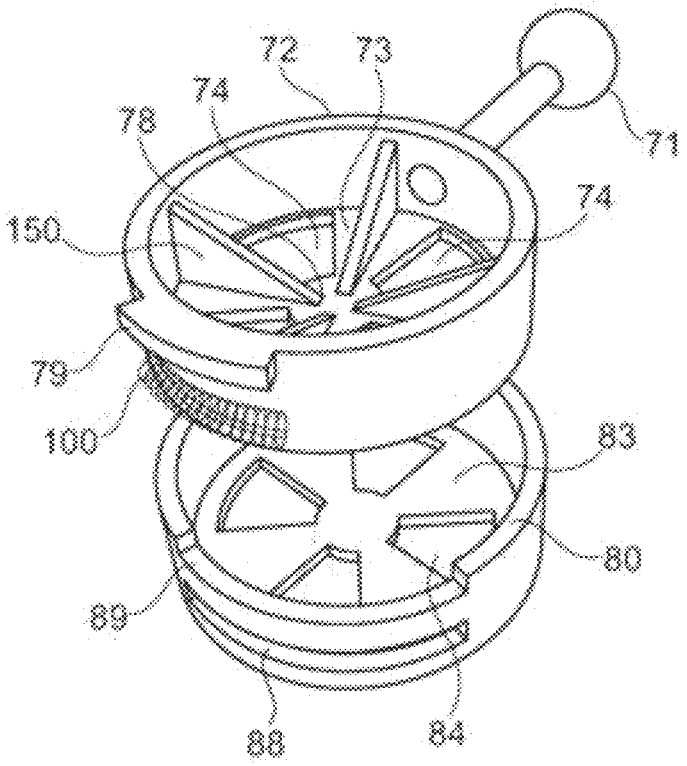
FIG. 16 is a view analogous to FIG. 15 of a variant device.

The separators 150 may be a different shape, and there has been represented in FIG. 16 by way of example a variant shutter in which the separators take the form of straight partitions connected perpendicularly to the bottom wall 73 in the median plane separating the two adjacent openings 74.

Figure 17:
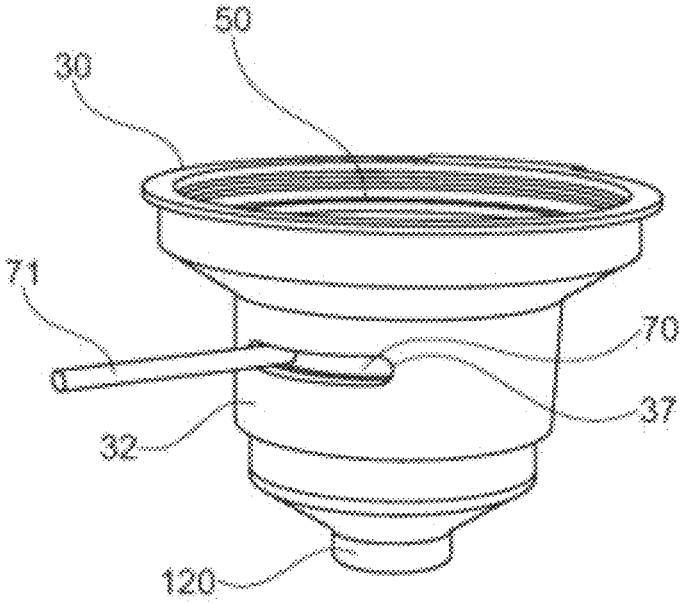
FIG. 17 represents a variant of the dispensing device in perspective.

The handle 71 may take multiple forms, for example the form of a straight rod with no ball at its end, as illustrated in FIG. 17.

Figure 18:
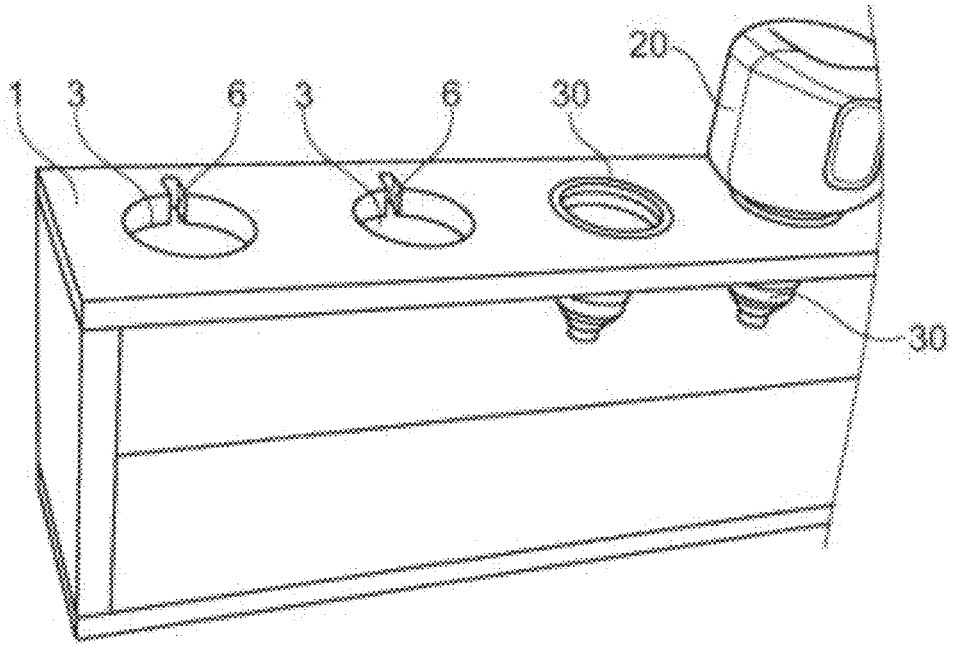
FIG. 18 represents a variant display unit.

The support 1 may be produced so as to enable placement of the dispensing devices 30 from above, the latter being retained for example by pressing a flange 160 provided at the end of the body 32 against the top face of the support wall 1 flanking the opening 3, as can be seen in FIG. 18.

Each opening 3 may be provided with a cutout 6 allowing the passage of the handle 71 and, where appropriate, of the adjustment lever 91.

Of course, the invention is not limited to the embodiments that have just been described.

Numerous other modifications may be made to the containers, dispensing devices or supports without departing from the scope of the present invention.

For example, the dispensing device 30 may be produced with no flow rate adjustment lever, the third part 90 being absent or mounted in a manner that is not adjustable from the outside in a position corresponding to the required flow rate. If necessary, the flow rate may be adjusted merely by moving the handle 71 of the shutter.

The number of openings and the shape of the openings produced in the first and second parts may be different.

Markers or detents may be provided to assist the user to assess the movement of the handle 71 of the shutter or of the lever 91 for adjustment of the flow rate.

A variant of the dispensing device 30 has been represented in FIGS. 19 to 27.

Figure 19:
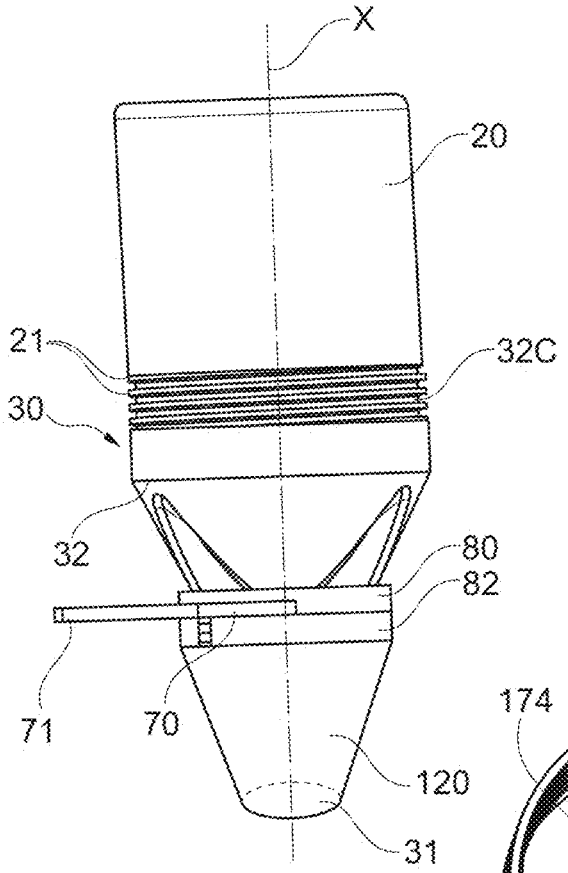
FIG. 19 represents a variant dispensing system in accordance with the invention in perspective.

In the example illustrated the dispensing device 30 includes a body 32 having a top part 32*c* of cylindrical shape threaded internally for fixing it into the threaded neck 21 of the container 20, as illustrated in FIG. 19.

The body 32 includes separators 150 projecting toward the container 20.

The body 32 is connected at the bottom to a second part 80. Unlike in the embodiments described above, the second part 80 is disposed outside the body 32.

This second part is fixed relative to the body 32. The latter is in particular fixed in a permanent manner, for example by welding, brazing, riveting, gluing or any other means.

Alternatively, the second part is fixed to the body in a removable manner, for example screwed thereto.

In the example illustrated, the second part 80 includes tubular skirt 82 and a bottom wall 83 through which pass three openings 84 disposed at 120° to one another.

Figure 20:
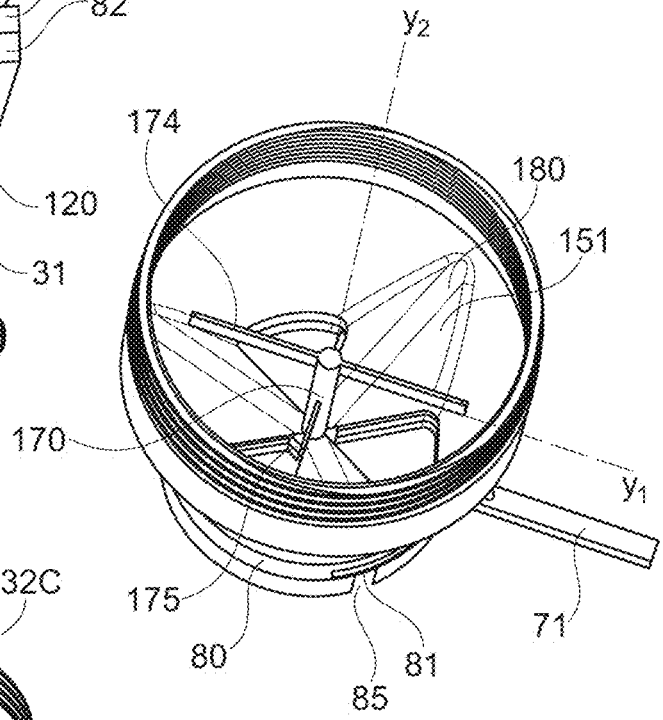
FIG. 20 represents separately the dispensing device from FIG. 19 as seen from below.
Figure 21:
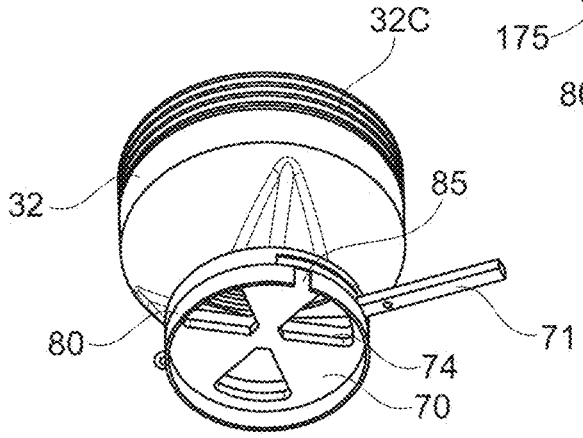
FIG. 21 is a view as seen from below of the dispensing device from FIG. 19.

To facilitate the flow of the bulk product toward these openings 82 the separators 150 of the body 32 advantageously have inclined flanks 151, as illustrated in FIG. 20 in particular.

The flow may equally be guided by means of a guide member 170 serving as a funnel. The latter is disposed at the center of the body 32, in particular at the bottom of the flanks 151.

In the example illustrated, the guide member 170 includes a rod having an axis coinciding with the longitudinal axis X of the system 10. The rod 170 includes first and second rod portions 171 and 172 with different diameters separated by a shoulder 173.

The first rod portion 171 includes a plurality of paddles 174 and 175 extending laterally from the rod, for example perpendicularly thereto.

Figure 25:
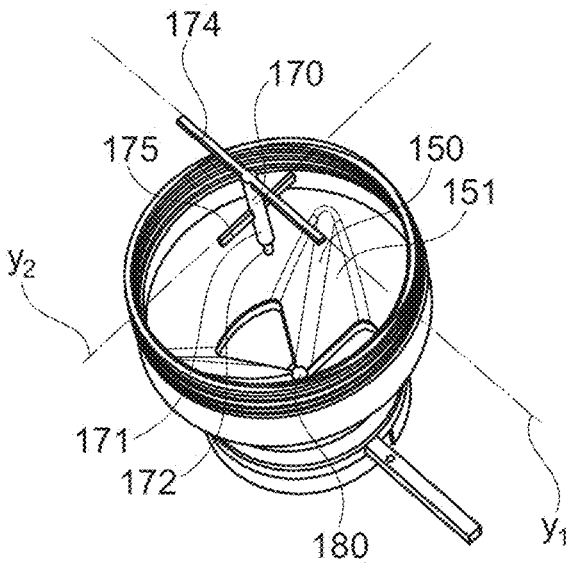

FIG. 25 illustrates an example in which the first rod portion 171 includes two pairs of paddles 174 and 175 extending at different heights from the shoulder 173. The paddles of each pair extend on either side of the rod, at the same height, in opposite directions along the same axis of extension Y1 or Y2. The axes of extension of the two pairs Y1 and Y2 are preferably perpendicular.

The second rod portion 172 extends through a central opening 195 in the body 32.

The opening 195 is preferably formed by a tubular abutment 190 of the body extending downward along the longitudinal axis X of the system 10 through an orifice 180 in the second part 80.

Figure 24:
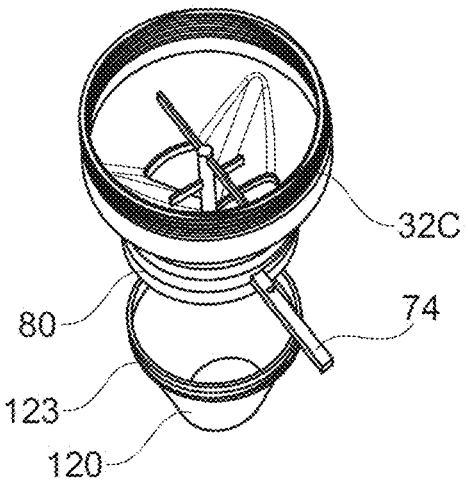
FIGS. 24 to 27 are exploded views of the device from FIG. 19, FIGS. 28*a* to 28*c* illustrate different positions of the third part of the shutter.

The tubular skirt 82 includes a thread for fixing a spout 120, as illustrated in FIGS. 19 and 24.

Figure 26:
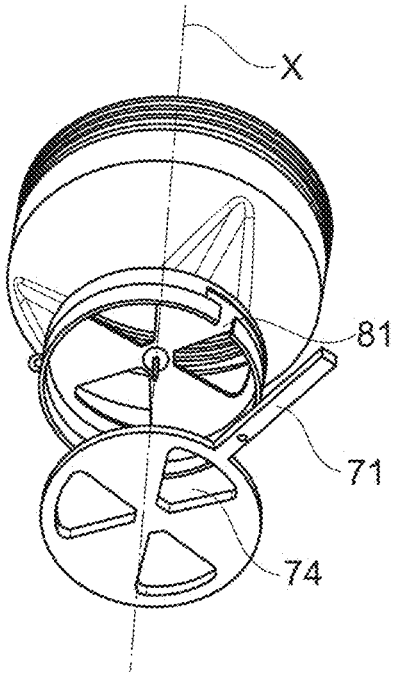
Figure 27:
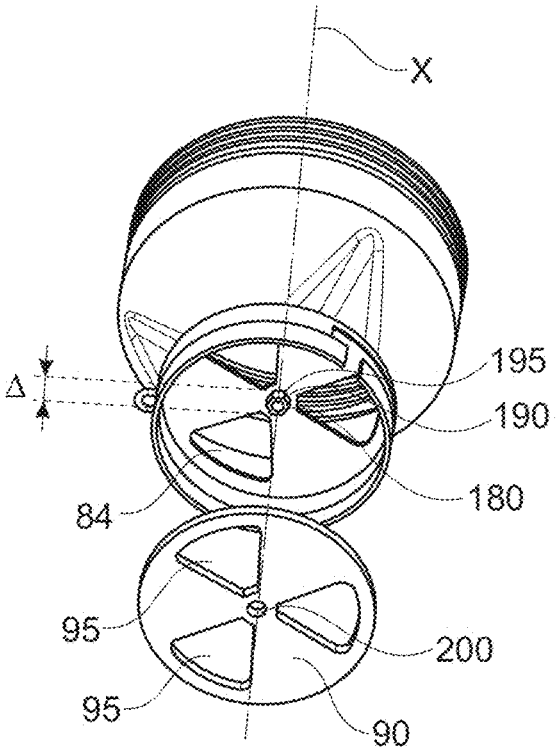

The second part 80 accommodates a first part 70 provided with a control handle 71 and a third part 90, as illustrated in FIGS. 26 and 27.

The first part 70 and second part 80 together form a shutter.

As described above, the first part 70 is mobile relative to the second part 80. The latter is able to turn about the longitudinal axis X of the system 10 when the user moves the handle 71. The latter is accessible from the outside through an opening 81 in the second part 80. In the example illustrated, the handle 71 is a straight rod.

The second part 80 includes a passage 85 for the handle 71 thereby facilitating mounting and demounting the first part 70.

The first part 70 includes a tubular skirt 72 concentric with the skirt 82 and guided in its movement in rotation by the latter and a bottom wall 73 through which openings 74 pass, here three in number.

Like the embodiments referred to above, a return spring, not shown, is disposed between the first and second parts 70 and 80. The latter acts between the first and second parts 70 and 80 to urge the first part into a blocking position in which the openings 74 in the bottom wall 73 overlie the solid parts of the bottom wall 83.

The blocking position advantageously corresponds to the handle 71 coming to abut against one end of the opening 81.

When the handle 71 is actuated, the first part 70 is moved angularly relative to the second 80 and the openings 74 and 84 overlap, as illustrated in FIGS. 21*a* and 21*b*, which allows the product to pass through.

Figure 22:
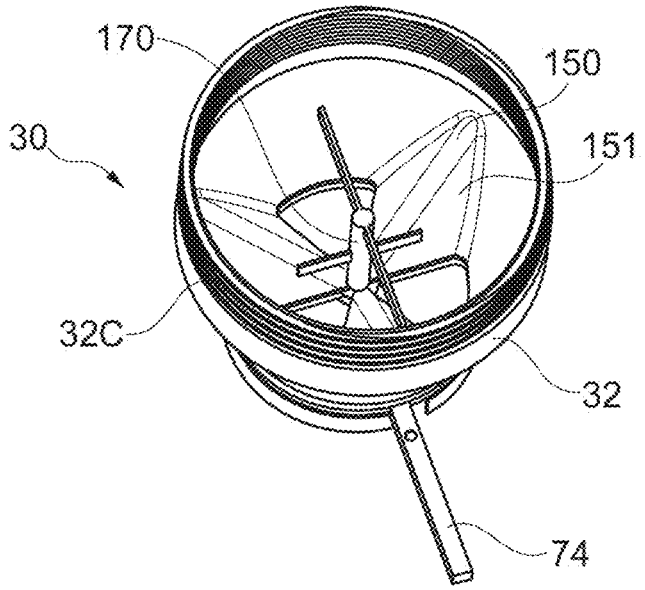
FIG. 22 is a view analogous to FIG. 20 in which the shutter is in closed mode.
Figure 23:
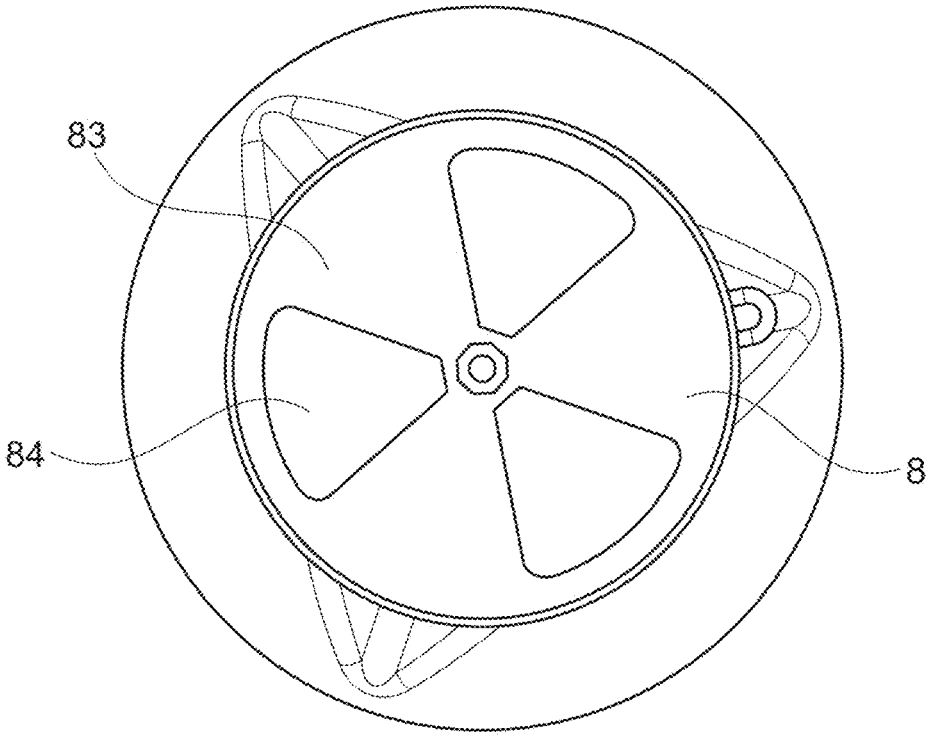
FIG. 23 represents separately the body and the second part of the device from FIG. 19 as seen from below.

When the handle 71 is released the spring returns it to the blocking position as illustrated in FIG. 22.

The third part 90 is situated axially under the second part 80, between the latter and the first part. This third part includes a bottom wall 94 with openings 95 through it that are for example, as illustrated in FIG. 27, three in number and disposed at 120° from one another.

Figure 28A:
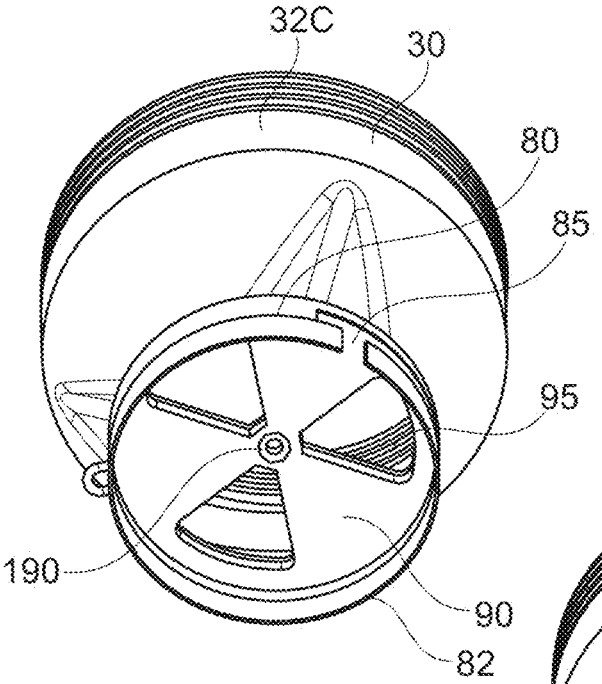
Figure 28B:
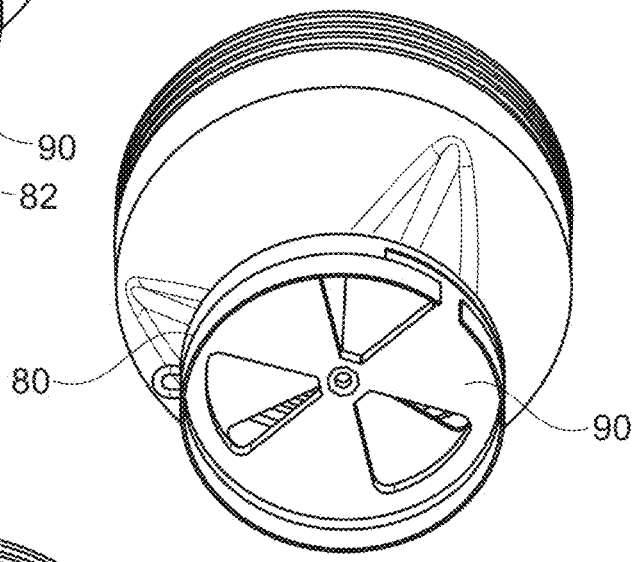
Figure 28C:
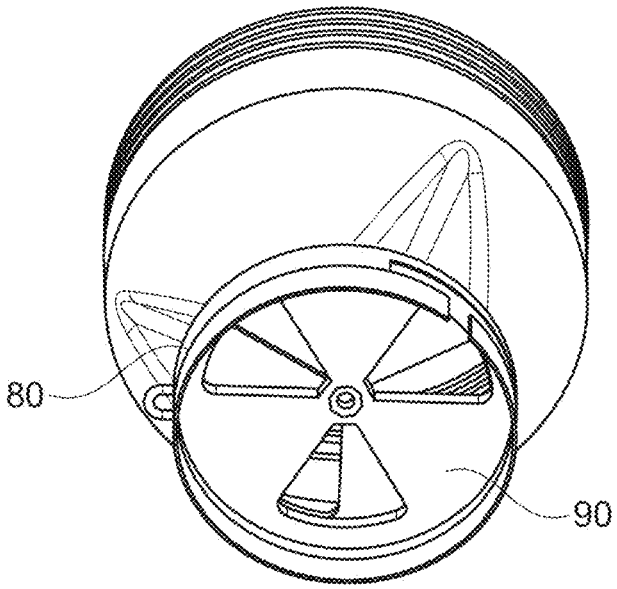

In the example illustrated the third part 90 is mounted in a manner that is not adjustable from the outside in a position corresponding to the required flow rate. Accordingly, depending on the angular position of the third part relative to the second, the openings 95 overlap to a greater or lesser degree the openings 84 and the passage section offered to the product is modified, as illustrated in FIGS. 28*a* to 28*c*, which makes it possible to act on the flow rate of the flow.

The third part 90 has a central orifice 200, visible in FIG. 27, for the passage of the abutment 190. This allows in particular the fixing of the third part 90 relative to the second. This also allows the bottom wall 92 to come into direct contact with the wall 82 of the second part. Of course, the invention is not limited to the embodiments that have just been described.

For example, the fixing of the container 20 on the dispensing device 30 can be carried out other than by screwing, as described with reference to FIGS. 29 and 30.

In the embodiment illustrated in these figures, the body 32 of the device has a cylindrical part 32*c* serving as a nozzle for the removable fixing of the container.

The body 32 has an internal part 32*d* disposed inside the cylindrical part 32*c*. This part has a frustoconical shape that widens toward the container. The two parts are fixed by welding for example.

The internal part 32*d* is connected at the bottom to a second part 80. The part 80 may be fixed to the internal part, in particular by welding it thereto.

As described above, the second part 80 has a tubular skirt 82 and a bottom wall 83 through which pass three openings 84 arranged at 120° to one another.

Figure 30:
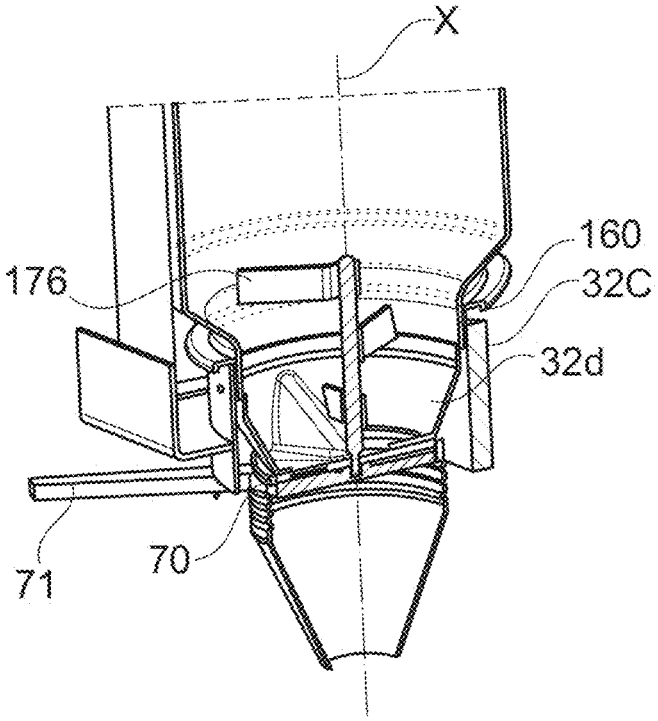
FIG. 30 is a view of the system from FIG. 30 in longitudinal section.

In the same way as in the embodiment illustrated in FIGS. 19 to 28*c*, the separators 150 of the body 32 have inclined flanks 151, as illustrated in FIG. 30 in particular.

The flow is also guided by means of a guide member 170 serving as a funnel. This is arranged at the center of the body 32, in particular at the foot of the flanks 151, and is similar to the guide member described above.

Figure 29:
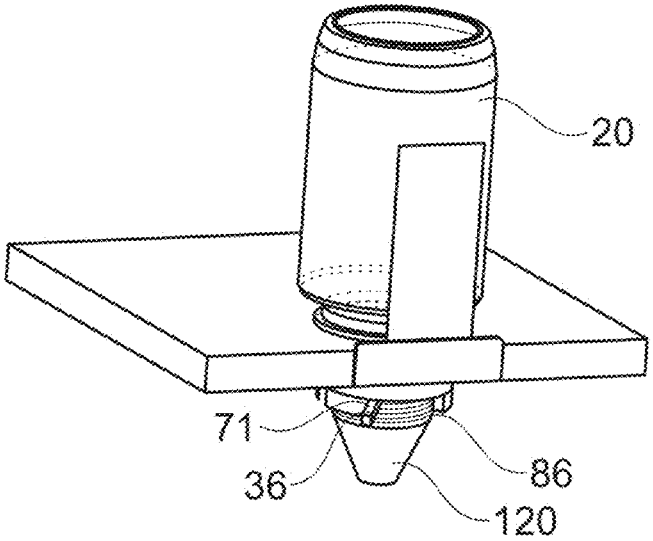
FIG. 29 represents a variant dispensing system in perspective.

The tubular skirt 82 has a thread for fixing a spout 120, as can be seen in FIGS. 29 and 30.

The second part 80 accommodates a first part 70, provided with a control handle 71, and a third part 90, as illustrated in FIGS. 26 and 27.

The first part 70 and the second part 80 together form a shutter.

In the example illustrated, the handle is accessible from the outside through a first notch 86 of the second part 80 and a second notch 36 of the body 32 superimposed on the first.

The first part 70 includes a tubular skirt 72 concentric with the skirt 82 and guided in its rotation movement by the latter and a bottom wall 73 through which pass openings 74, here three in number.

As in the embodiments mentioned above, a return spring, not illustrated, is disposed between the first and second parts 70 and 80. The latter spring acts between the first and second parts 70 and 80 to urge the first part into a blocking position in which the openings 74 in the bottom wall 73 overlie the solid parts of the bottom wall 83.

The blocking position advantageously corresponds to the handle 71 coming to abut against one end of the notch 86 and/or of the notch 36, the notches 86 and 36 advantageously having the same angular extent and the same height.

The operation of the first part is similar to that of the embodiments described above.

The third part 90 is situated axially under the second part 80, between the latter and the first part. This third part includes a bottom wall 94 through which pass openings 95 that, as illustrated in FIG. 27, are advantageously three in number and disposed at 120° to one another.

In the example illustrated the third part 90 is mounted in a manner that is not adjustable from the outside in a position corresponding to the required flow rate.

The tubular skirt 82 includes a thread for fixing a spout 120, as described above with reference to FIGS. 29 and 30.

The support 1 may be adapted to allow placement of the dispensing devices 30 from above, the latter devices being for example retained by a flange 160 provided at the end of the body 32 bearing against the top face of the support wall 1 flanking an opening 3 in the latter, as can be seen in FIG. 30.

In this example, unlike the above embodiments, the container is fixed without screwing, the container being simply placed on the device after turning it over so that the neck of the latter comes to bear against the lateral wall 32*d* of the body 32.

In the examples illustrated the guide member 170 is fixed relative to the body 32.

Alternatively, this guide member 170 is mobile relative to the body 32, as will be described hereinafter with reference to FIGS. 31 to 38.

In this example, as described above, the guide member consists of a rod 170 including first and second rod portions 171 and 172 with different diameters separated by a shoulder 173.

The first rod portion 171 includes a plurality of paddles 174 and 175 extending laterally from the rod, for example perpendicularly thereto.

The rod 170 is advantageously rigidly attached to the first part 70, in particular screwed thereto. The second rod portion 172 can therefore include a thread that is engaged in a threaded central orifice 77 of the bottom wall 71.

Also, when the first part 70 is moved angularly relative to the second 80 by the handle the rod 170 and the paddles 174, 175 and 176 are driven in rotation which enables both guiding of the product toward the openings 84 of the second part and stiffing thereof.

In the embodiments illustrated the second part 80 includes a skirt 82 of frustoconical shape.

The second part 80 includes openings 84 and between the openings thereof separators 150 projecting toward the container 20.

These separators 150 advantageously have inclined flanks 151 guiding the flow toward the openings 84 situated at their base.

The second part 80 is fixed, in particular welded, to the body 32 of the device.

The second part 80 includes a central orifice 180 for the second rod portion 171 to pass through.

A return spring 100 is attached at its ends to the parts 70 and 80, respectively. To this end the first and second parts each include an attachment point 270 and 260 of the corresponding end of the spring 100, as can be seen FIGS. 34 and 35 in particular.

In this embodiment the third part 90 is absent. If necessary, the flow rate can be adjusted merely by moving the handle 71 of the shutter. The system 1 advantageously includes a plurality of first parts with openings of different sizes that mount in the device as a function of the bulk product and the flow rate required.

The device includes a spout 120 that nests in the body 32. The latter preferably includes an abutment 33 to prevent undesirable descent of the spout into the body. The spout 120 includes spigots 123, in particular flexible spigots, to improve the retention of the latter against the internal wall of the body 32.

The system 10 also includes a clamping part 230 for retaining the dispensing device 30 on the support 1.

Figure 32:
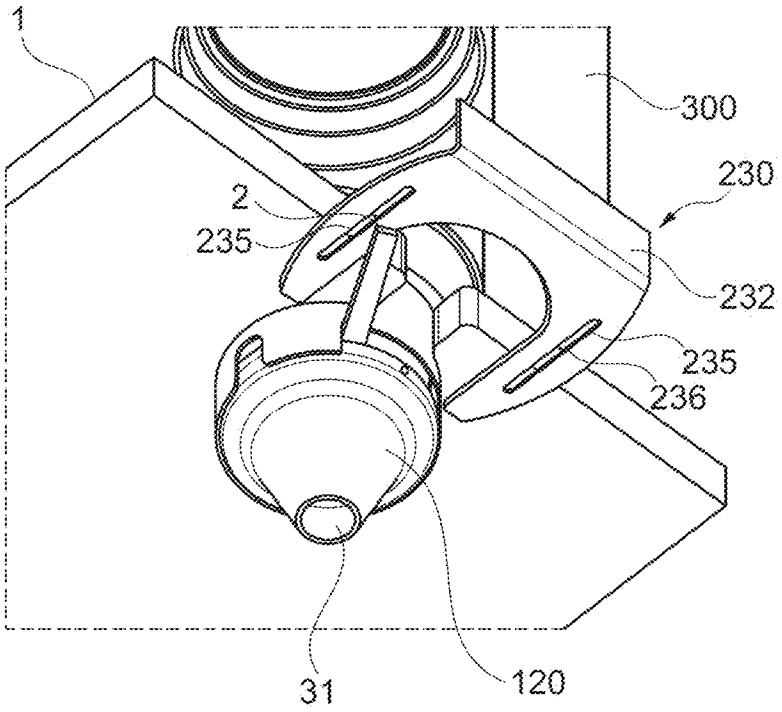
FIGS. 32 and 33 are exploded views of the system from FIG. 31 in the exploded state.

As illustrated in FIG. 32, the clamping part advantageously includes a plate 232 that comes to abut against the lateral edge 5 of the support 1 and two forks 235 substantially perpendicular to the plate 232.

In the example illustrated, the forks 235 engage in grooves 250 formed on the lateral wall of the body 32, which enables tilting of the system once installed on the support to be prevented.

In order to improve the retention of the clamping part 230 against the support the forks 235 may each include a slot 236 for the passage of one or more fixing means 400 such as screws for example.

Figure 31:
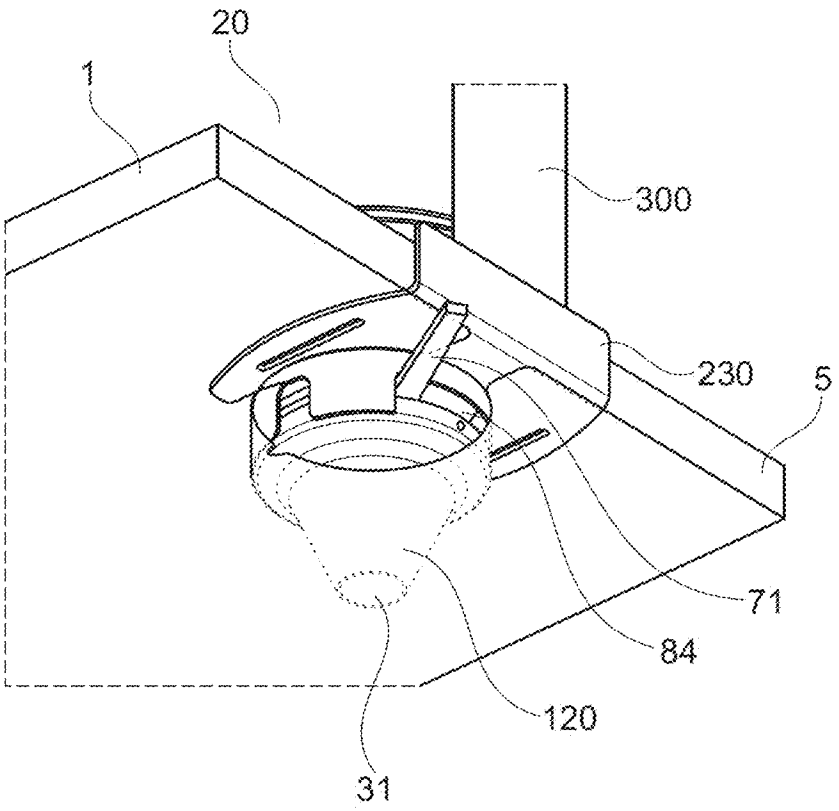
FIG. 31 represents a variant dispensing system in accordance with the invention in perspective.
Figure 34:
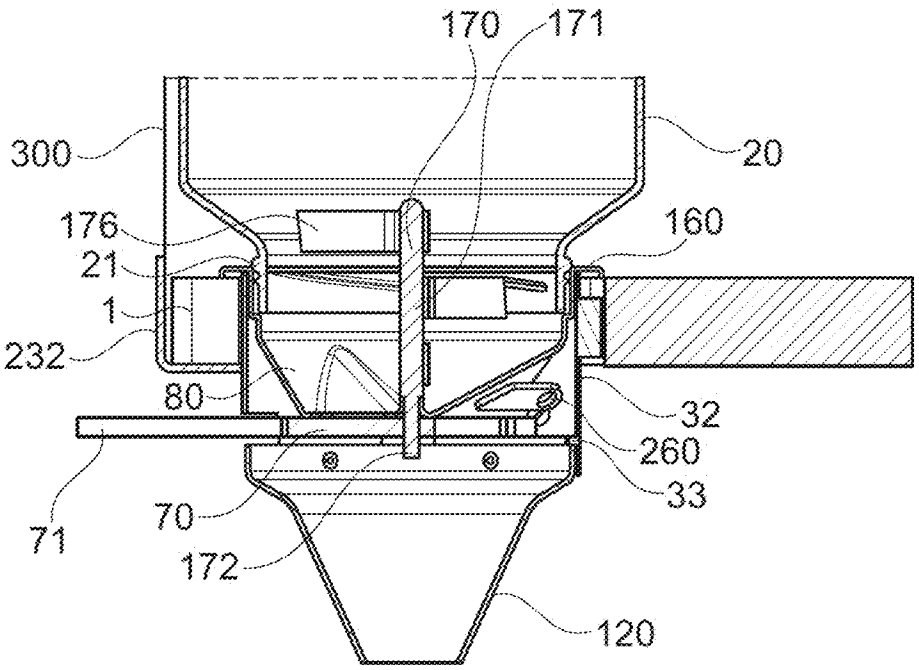
FIG. 34 is a view of the system from FIG. 31 in longitudinal section.
Figure 33:
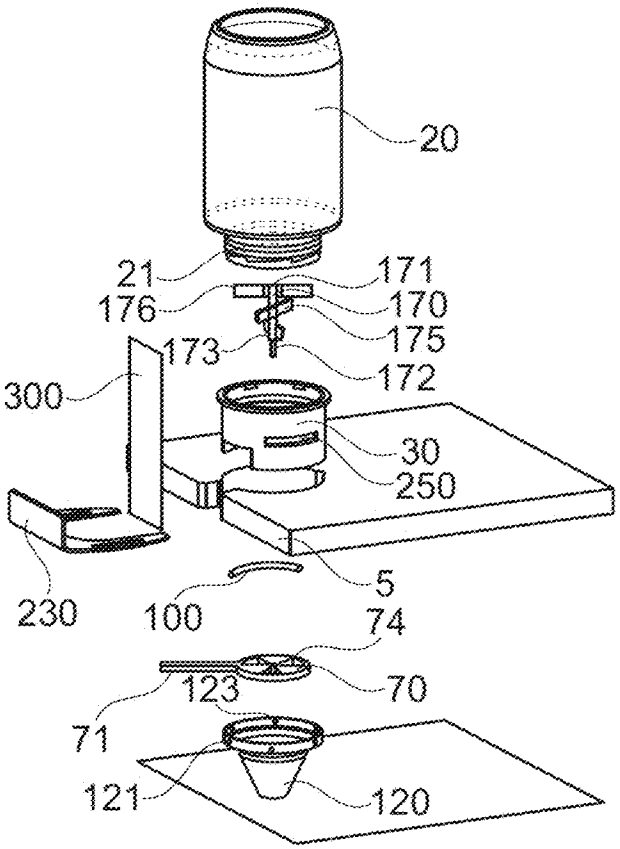
Figure 36:
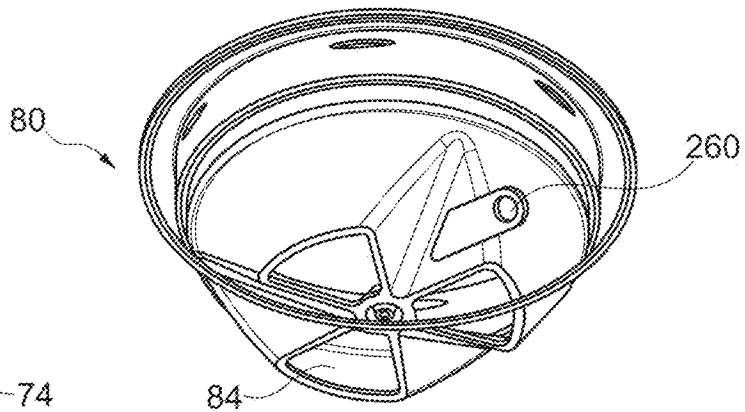
FIGS. 35 and 36 represent separately in perspective the first and second parts of the shutter of the system from FIG. 31, respectively.
Figure 38:
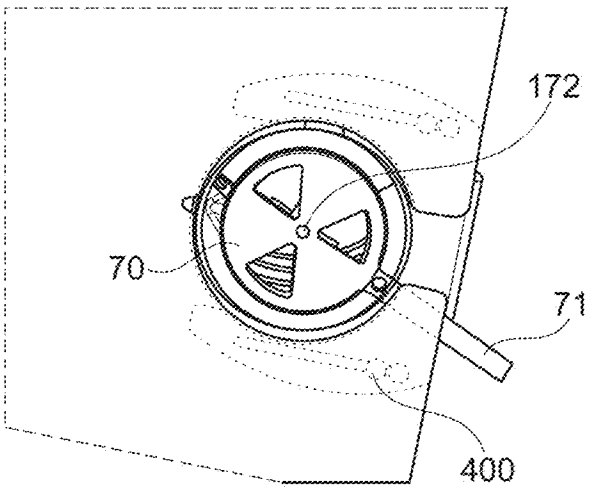
FIG. 38 is a view as seen from below of the system from FIG. 31 without the spout.
Figure 35:
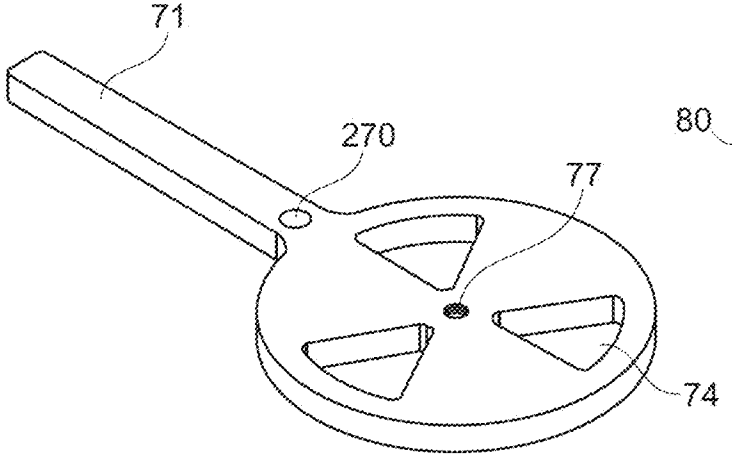
Figure 37:
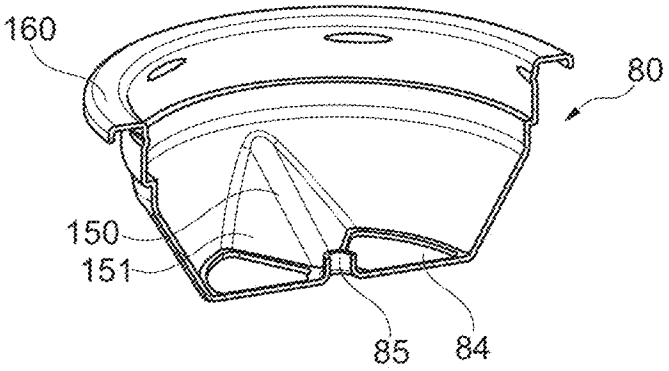
FIG. 37 represents separately in longitudinal section the second part of the shutter.

The clamping part 230 may also serve for fixing a label 300 for displaying for example information relating to the type of bulk product, its source, its price or any other useful information, as can be seen in FIGS. 31 to 33 in particular.

The invention claimed is:

1. A device for dispensing by gravity a bulk solid product in stores, including:

in a top part, a nozzle for removably fixing the top part to a container, in a bottom part, a dispensing orifice, a rotary shutter including a first part with an actuating handle that is mobile with a maximum travel in rotation less than or equal to 180°, relative to a second part, the first part including a plurality of first part walls and a plurality of first part openings, the second part including a plurality of second part walls and a plurality of second part openings, the plurality of first part walls and the plurality of first part openings overlapping with the plurality of second part walls and the plurality of second part openings in a proportion depending on a position of the actuating handle.

2. The device as claimed in claim 1, wherein between respective openings of the plurality of first part openings of the first part separators are projecting toward the container.

3. The device as claimed in claim 2, wherein the separators of the first part each have inclined flanks that are configured for guiding flow of the bulk solid product toward the plurality of first part openings situated at a base of each of the respective flanks, or the separators are formed as partitions oriented perpendicular to a wall of the plurality of first part walls to which they are each connected at a respective separator base.

4. The device as claimed in claim 1, further comprising a spring for urging the first part into a position closing the rotary shutter, and/or the dispensing orifice is defined by a spout.

5. The device as claimed in claim 1, further comprising a third part the position of which relative to the second part enables adjustment of the flow rate of the flow reaching the dispensing orifice.

6. The device as claimed in claim 5, wherein the third part is mobile relative to the second part, the third part being constrained to move with an adjustment lever, and/or the third part being configured to be removably received in a body of the device.

7. The device as claimed in claim 6, wherein the actuating handle and the adjustment lever are situated on the same side of the device, or the actuating handle and the adjustment lever are situated on opposite sides of the device.

8. The device as claimed in claim 1, wherein the nozzle is threaded internally for fixing the top part onto the container by screwing it thereto, a neck of the latter being threaded, or the nozzle having no thread.

9. The device as claimed in claim 1, wherein the first and second parts being received in a corresponding housing of a body of the device and adapted to nest one within the other, or the first and second parts being disposed outside a body of the device and adapted to nest one within the other.

10. The device as claimed in claim 1, wherein a body of the device includes separators projecting toward the container and/or the second part including separators projecting towards the container.

11. The device as claimed in claim 10, wherein the separators have inclined flanks for guiding the flow toward the openings in the second part situated at a base of the flanks.

12. The device as claimed in claim 1, further comprising a guide member serving as a funnel.

13. The device as claimed in claim 12, wherein the guide member includes a rod having first and second portions separated by a shoulder, the first rod portion including a plurality of paddles guiding the flow toward the second part openings in the second part.

14. The device as claimed in claim 12, wherein the guide member is rigidly attached to the first part, the guide member is mobile relative to the second part or the guide member is fixed relative to the second part.

15. The device as claimed in claim 14, wherein a second rod portion includes a thread engaging in a central orifice in the first part.

16. The device as claimed in claim 10, wherein the separators each have inclined flanks that are sloping away from a from a radially extending inclined center ridge, wherein the separators are configured for guiding the flow toward the plurality of first part openings situated at a base of each respective flank of the inclined flanks.

17. The device as claimed in claim 9, wherein the second part is threaded internally.

18. A dispensing system comprising a container to contain the product to be dispensed and a dispensing device as claimed in claim 1 fixed to the container.

19. The system as claimed in claim 18, further comprising a clamping part adapted to retain the device on a support.

20. A display unit including a support and a dispensing system as claimed in claim 18 retained by the support.

21. The display unit as claimed in claim 20, the support including at least one opening and the support and the container being adapted to allow the container to be positioned in the opening in a stable manner on the one hand in a configuration of use in which the container is equipped with the dispensing device and on the other hand in an overturned filling or assembly configuration in which the dispensing device has been removed.

22. The display unit as claimed in claim 21, wherein the opening including at least one notch for the shutter control handle to pass through.

23. The display unit as claimed in claim 22, wherein the notch opens toward a lateral edge of the support.

* * * * *